US005426444A

United States Patent [19]

Sauter et al.

[11] Patent Number: 5,426,444

[45] Date of Patent: Jun. 20, 1995

[54] ARRANGEMENT FOR ACCOMMODATING TELESCOPING MASTS, PARTICULARLY ON MOBILE CARRIERS

[75] Inventors: Josef Sauter, Oberteuringen; Peter Petrovsky, Constance, both of Germany

[73] Assignee: Dornier GmbH, Friedrichshafen, Germany

[21] Appl. No.: 897,675

[22] Filed: Jun. 12, 1992

[30] Foreign Application Priority Data

Jun. 12, 1991 [DE] Germany ..... 41 19 321.0

[51] Int. Cl.[6] ..... H01Q 1/10; B66C 23/06

[52] U.S. Cl. ..... 343/883; 52/118; 52/121; 343/878

[58] Field of Search ..... 343/883, 878, 881, 882; 52/118, 121, 116, 111, 117

[56] References Cited

U.S. PATENT DOCUMENTS 2,695,082 11/1954 Mills ..... 52/118
3,109,522 11/1963 Womack et al. ..... 52/118
3,495,364 2/1970 Bella ..... 52/118
4,932,176 6/1990 Roberts et al. ..... 343/883
5,117,595 6/1992 Brendel ..... 52/118

FOREIGN PATENT DOCUMENTS 1073712 1/1960 Germany .
3202836 8/1983 Germany .

*Primary Examiner*—Donald Hajec
*Assistant Examiner*—Hoanganh Le
*Attorney, Agent, or Firm*—Evenson, McKeown, Edwards & Lenahan

[57] ABSTRACT

An arrangement for accommodating telescoping masts on mobile carriers comprises devices for selectively swivelling the mast into a transport position or an operating position for support with respect to the ground surface for the raising of the mast into its operating position. The mast swivel bearing is provided on the carrier so that it can be adjusted or adapted for the respective adaptation of the center of gravity of the mast with respect to the mobile carrier, with respect to the transport position with vehicle wheels resting on the ground, and relative to the starting operating position of the mast with carrier supports resting on the ground surface.

16 Claims, 5 Drawing Sheets

ARRANGEMENT FOR ACCOMMODATING TELESCOPING MASTS, PARTICULARLY ON MOBILE CARRIERS

BACKGROUND AND SUMMARY OF THE INVENTION

This invention relates to an arrangement for accommodating a telescoping mast, particularly on a mobile carrier, comprising devices for selectively swivelling the mast into an essentially horizontal transport position while the telescopic elements are retracted, or into a perpendicular operating position while the telescopic elements are extended, in which the mast or the carrier are supported with respect to the ground surface by means of supports.

Such telescoping masts are used, for example, as carriers of antennas for radio communications, for television transmissions or other transmitting or receiving purposes or as relay stations.

It is a requirement that mobile operating systems of the above-mentioned type can be set up and taken down within a very short time and, for economic reasons, with the lowest possible equipment-related expenditures and the minimum use of personnel.

It is known to perpendicularly extend masts of the above-mentioned type to a given height by means of elements that can be slid into one another or on one another, to brace the masts in this position and to support them with respect to the ground by means of extendable base parts or supporting arms. For the transport, the telescopic elements are retracted and the masts are swivelled into a horizontal transport position.

An arrangement of this type is known in which a telescoping mast is pivoted on a supporting arm and can be adjusted by means of an adjusting device into a perpendicular operating position or a horizontal transport position while the telescopic elements are in the retracted position.

However, a number of difficulties exist with the known arrangement. These difficulties are caused by the design of the vehicle used for accommodating the mast and by the design of the accommodating device for the mast where raising and transporting the telescoping mast into the operating and transport positions results in disadvantages, particularly with respect to the center of gravity.

It is therefore an object of the present invention to eliminate the disadvantages of the known construction and provide an arrangement which is simplified with respect to the equipment; exhibits an improved efficiency with respect to achieving a faster setting-up and removal of the mast system, and has the best possible stability of the mast system with respect to the center of gravity in the operating position as well as in the transport position of the mast.

According to the present invention, this object is achieved by a special development of the accommodating device of the mast system on a mobile carrier for selectively swivelling the mast into a transport position or an operating position for the support with respect to the ground surface for the raising of the mast into its operating position. The mast swivel bearing is provided on the carrier so that it can be adjusted or adapted for the respective adaptation of the center of gravity of the mast with respect to the mobile carrier, with respect to the transport position with vehicle wheels resting on the ground, and relative to the starting operating position of the mast with carrier supports resting on the ground surface.

According further to especially preferred embodiments of the present invention, the mast swivel bearing is accommodated by means of a supporting structure by the frame part of the mobile carrier, and an adjusting device is provided which causes the relative movement between the mast and the mobile carrier in the longitudinal direction of the carrier.

According further to especially preferred embodiments of the present invention, the supporting structure of the mobile carrier with the mast swivel bearing or the bearing support can be placed and fastened on the supporting structure or the vehicle frame of the mobile carrier.

According further to especially preferred embodiments of the present invention the center of gravity of the mast with respect to the mobile carrier can be adjusted in the direction of the longitudinal axis of the vehicle and in the perpendicular direction or in a direction resulting from the individual adjusting devices.

According further to especially preferred embodiments of the present invention the center of gravity of the mast can be adjusted with respect to the mobile carrier transversely to the vehicle axis.

According further to especially preferred embodiments of the present invention for the adjusting of the mast system or of the center of gravity with respect to the mobile carrier in the direction of the vehicle longitudinal axis and in the perpendicular direction, a guiding device is provided providing guides and scanning elements which are guided on these guides in a restricted manner.

According further to especially preferred embodiments of the present invention, by means of the construction of the adjusting device, a combined swivel movement of the mast and of the mast swivel bearing can be caused with respect to the carrier in the direction of the vehicle longitudinal axis and in the perpendicular direction.

According further to especially preferred embodiments of the present invention, the mast swivel bearing is formed by interacting bearing elements on the shaft or on the supporting structure or on the carrier frame, and a gearing in the manner of a crank mechanism is applied by means of bearing rockers by way of joints in an articulated manner to the mast and to the supporting structure or to the carrier frame.

According further to especially preferred embodiments of the present invention, the bearing rockers, in the perpendicular operating position of the mast, take up a perpendicular or approximately perpendicular swivelled-out position on the supporting structure of the carrier.

According further to especially preferred embodiments of the present invention, the bearing bores of the mast swivel bearing have slots, and the bearing shafts have sections with flattenings which fit into the slots.

According further to especially preferred embodiments of the present invention, at a distance in the direction of the carrier longitudinal axis from the mast swivel bearing, between the mast and the supporting structure or the carrier frame, a mast guide is formed which comprises guide rollers and guide rails with guide ways extending in an inclined manner with respect to the horizontal line.

According further to especially preferred embodiments of the present invention, the guide rollers are freely rotatably arranged on fork parts of a bearing fork of the supporting structure and the guide rails are fixedly connected with the mast.

By means of an arrangement that is constructed according to the invention, it is achieved that the center of gravity of the mast system, in its operating position as well as in its transport position, is always in the center of gravity of the vehicle, whereby the projecting of the extendable and projectable supports required for erecting stability and resting on the ground surface can be minimized. In the case of such a construction, the transport supports may be advantageously mounted on the carrier frame of the carrier vehicle.

The construction also makes it possible for the carrier vehicle proper to be used as a balancing weight with respect to the mast, thereby maintaining erecting reliability while minimizing the projecting of the supports, particularly when the available erection surface is limited.

By means of the special construction of the mast swivel bearing, an advantageous center of gravity point of the mast system is also maintained along the entire adjustment path during the adjustment for the raising and retracting of the mast.

In addition, by means of the special construction of the mast swivel bearing, together with the construction of the supporting frame or of the vehicle frame, it is provided that, for the transport, the center of gravity of the mast or of the overall system is at an extremely narrow distance above the road surface. Also, when the mast is swivelled into the operating position, a displacement of the mast or its swivel bearing in the perpendicular direction is achieved and erecting height is correspondingly gained.

The development according to the invention permits a construction of the mast system on any series-constructed vehicle frame or load accommodating part without having to perform an expensive adaptation. In this case, both towing vehicles and trailers in a single-axle or multi-axle construction can be used.

Other objects, advantages and novel features of the present invention will become apparent from the following detailed description of the invention when considered in conjunction with the accompanying drawings.

DETAILED DESCRIPTION OF THE DRAWINGS

Figure 1A:
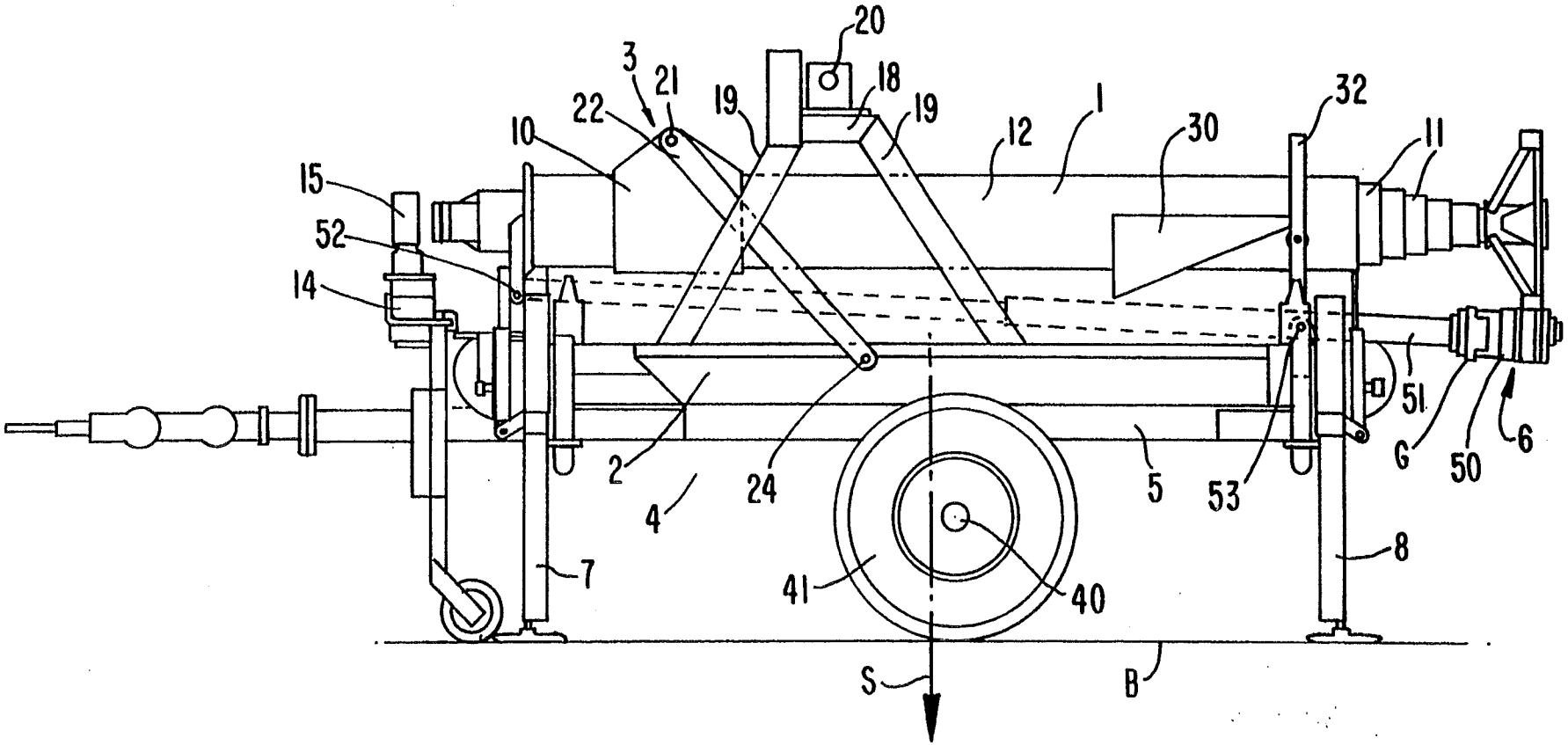
FIG. 1*a* is a schematic representation and a lateral view of the overall system with the mast in the transport position.

In the drawings of FIGS. 1*a*, 1*b*, 1*c*, and 2–4, the telescoping mast as a whole has the reference number 1, the supporting structure has the reference number 2, and the mast swivel bearing has reference number 3.

The illustrated mast system with its supporting structure 2 can be mounted as a mobile device on the frame 5 of the vehicle 4. The vehicle may, for example, be a single-axle trailer which, for the transport from or to a set-up site, is provided so that the trailer can be coupled to a towing vehicle (not shown).

In a known manner, the described mast system is constructed such that the mast 1 is provided to be adjustable about the mast swivel bearing 3 by means of the telescopic length changes either into a perpendicular operating position or into a horizontal transport position. In the transport position, the individual telescopic elements 11 are in their retracted position. In the operating position of the mast 1, the elements 11 are in the extended position.

The load of the system in the operating position of the telescopic mast is supported by means of extendable supports 7 or supporting arms 8 on the ground surface B, in which case the vehicle wheels 41 of the single-axle trailer 4 are brought into a lifted position in which the vehicle wheels no longer touch the ground B.

In the embodiment illustrated herein, the telescoping mast 1 is formed by a tube-shaped element carrier 12 which is fixedly connected with a mast carrier 10 and is used for accommodating a number of telescopic elements 11 which are disposed inside one another and can be adjusted by means of an adjusting mechanism.

The adjustment of the telescopic elements 11 is caused by a spindle—nut gearing of a known construction and by a driving motor 14 which uses a step-up gearing 15.

The supporting structure 2 has a carrying frame with a bearing support 18 which is accommodated by supports 19. The mast carrier 10 of the element carrier 12 is supported on the bearing support 18 by means of the mast swivel bearing 3.

The mast swivel bearing 3 is formed of two coaxial bearing shafts 20 on the mast carrier 10 of the element carrier 12 and by corresponding bearing bores 21 in the bearing support 18.

Bearing rockers 22 are applied to the mast 1 in an articulated manner by way of the bearing shafts 20 on both sides of the mast 1. The rockers 22 are freely movable and are used for the swivel bearing 3 of the mast. As will be explained in detail hereinafter, the rockers 22 are used for parallel swivelling of the bearing shafts 20 of the mast swivel bearing 3 on a part of a circular path from the mast operating position into a transport position and vice versa.

A bearing fork 32, comprising fork parts 32', is fixed to the supporting structure 2 for accommodating the mast 1 in the transport position. Guide rollers 31, disposed on the fork parts 32' in a freely rotatable manner, interact with the guiding surface 30' of guide rails 30 extending in a sloped manner with respect to the horizontal line. The rails 30 are fixedly connected with the mast 1 or the element carrier 12 of the mast 1 on both sides of the longitudinal center plane of the mast.

A swivel drive 6, which comprises a motor operator 50 and an adjusting spindle nut gearing 51 is provided for swivelling the mast 1 about its bearing 3. The adjusting spindle is applied in a freely swivelling manner to the element carrier 12 or to the mast carrier 10 by way of a joint 52 in the area of the lower mast section. Reference number 53 indicates another swivel bearing wherein swivel drive 6 is supported on the supporting structure 2 in an articulated manner.

Figure 4A:
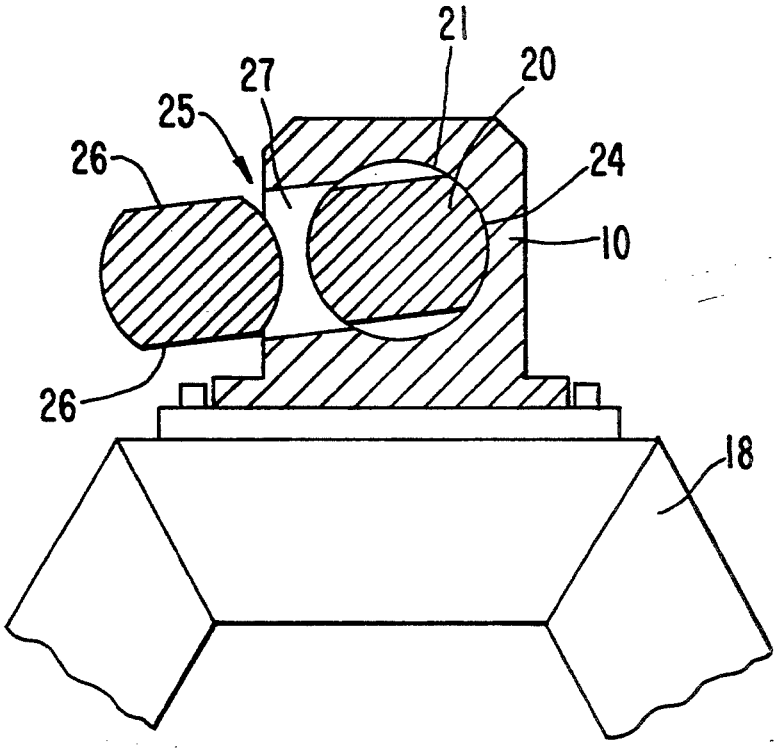
FIG. 4*a* is an enlarged cross-sectional view of FIGS. 1*a*, 1*b*, and 1*c* of a detail of a swivel bearing of the mast.
Figure 4B:
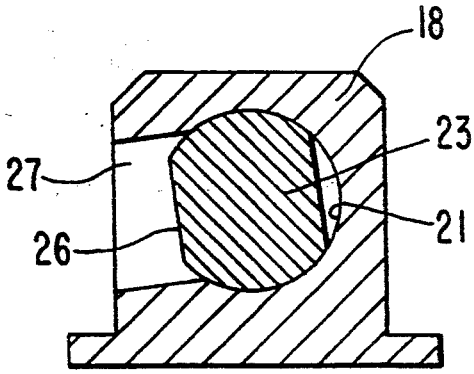
FIG. 4*b* is a view of a detail according to FIG. 4*a* in a changed swivel position of the swivel bearing of the mast.

Referring to FIGS. 4*a* and 4*b* of the drawing, a bearing lock 25 is provided wherein the bearing shafts 20 of the mast carrier 10 have flattenings 26 which are in parallel with respect to one another. The mast carrier 10 contains the bearing bores 21 and has slots 27 dimensioned corresponding to the flattened bearing shafts 20 for engaging and disengaging of the bearing shafts 20 with or from the mast 1 in the final swivel position when the mast 1 is raised. During the raising movement or retracting movement, the mast 1 is accommodated only by the joints 23 of the bearing rockers 22 and is correspondingly guided on a circular path.

The reference character 22 shows the pivot member which is pivotally connected at the vehicle frame 2 by means of the bearing 24 at one end and at the other end it carries the axle 21 of the mast pivot bearing 3.

In the end position shown in FIG. 1*a*, the mast 1 is disposed as low as possible. Also the center gravity S is low and disposed at the pivot point axis somewhere over the wheel axis 40. The pivot drive 22, 21, 24, 10 facilitates erection of the mast in the pivot point axle according to FIG. 1*c* and automatically to the swinging position of FIG. 1*a* whereby the mast in FIG. 1*c* is disposed at a higher level and therewith the maximal extension of the mast is achieved.

In the working position of the mast 1, the bearing axles 20 are engaged with the bearing bore 21 of the bearing bridge 18 (FIG. 4*b*).

Figure 1B:
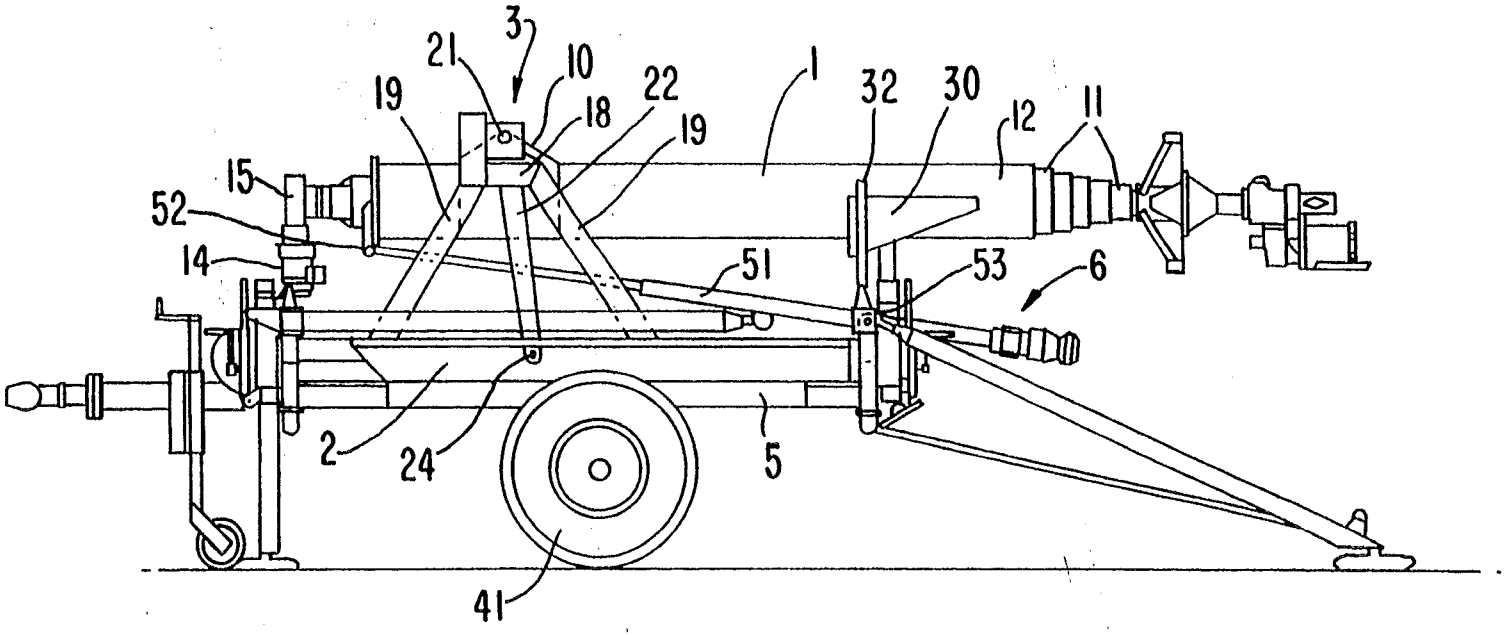
FIG. 1*b* is a schematic representation and a lateral view of the overall system with the mast in the starting swivel position.
Figure 1C:
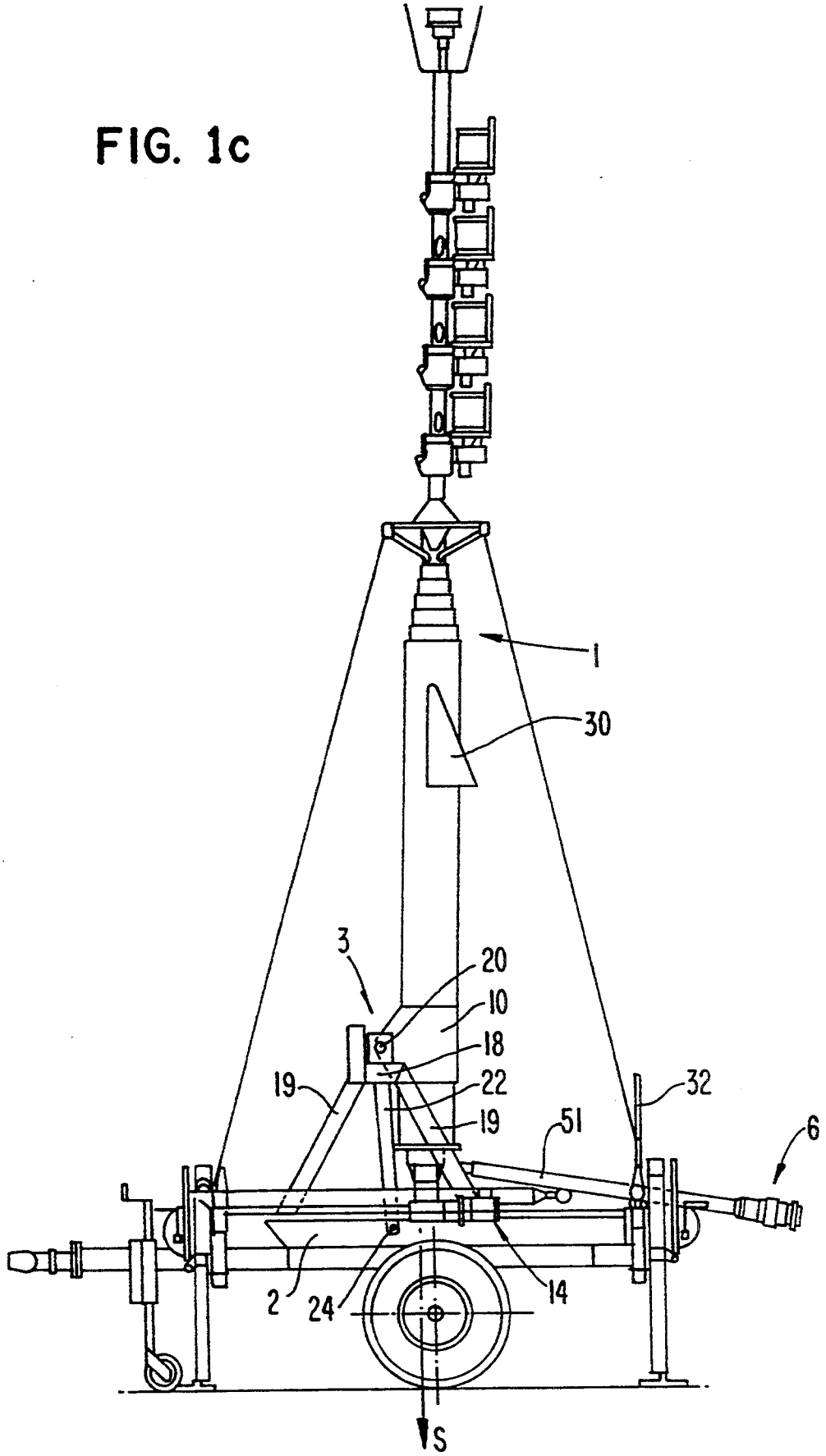
FIG. 1*c* is a schematic representation and a lateral view of the overall system with the mast in the final perpendicular extended position.
Figure 2:
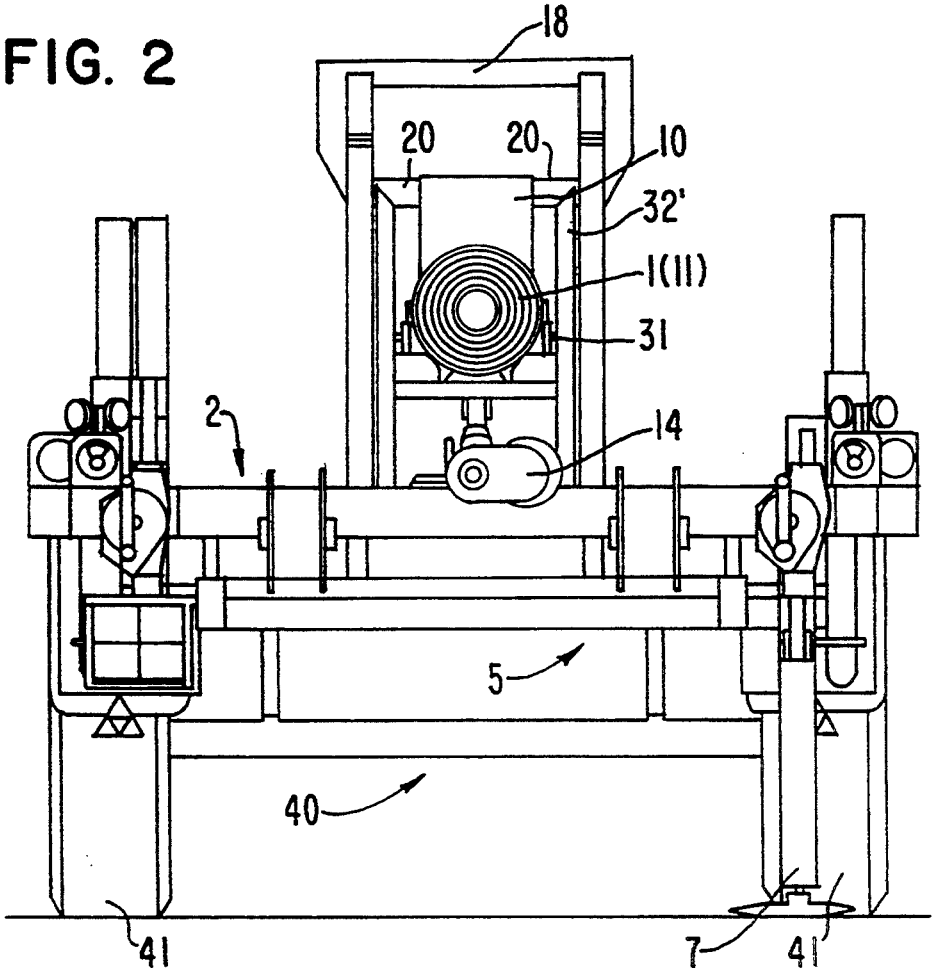
FIG. 2 is a rear view of the mast system according to FIG. 1*b*.

Through actuation of the pivot drive 6, the mast is moved in the position of FIG. 1*b*, which means that the bearing axles 20 meet through the pivot movement of the pivot arm 22 out of the bearing bore and the mast 1 would only then only be carried by the pivot arm 22.

Figure 3:
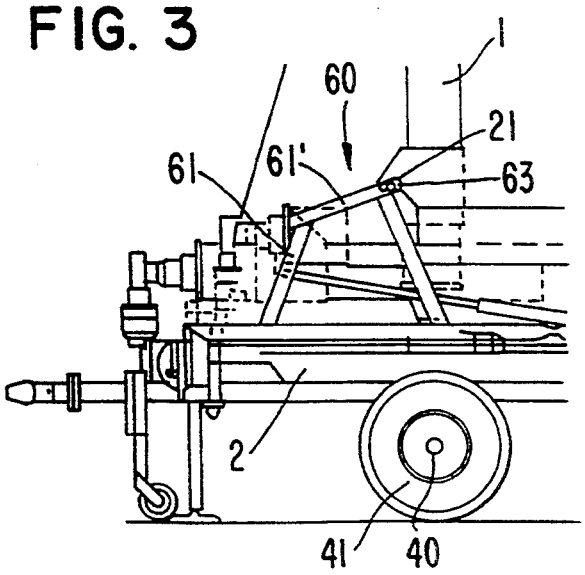
FIG. 3 is a cutout of the schematic and the lateral view of FIGS. 1*a*, 1*b*, and 1*c* showing another embodiment of the swivel bearing of the mast.

In another embodiment according to FIG. 3 of the drawing, a rail guide 60 is provided for the mast swivel bearing 3 instead of the bearing shafts 20 and the bearing bores 21 and the bearing rockers 22.

The guide 60 comprises U-shaped guide rails 61, 61' arranged on both sides of the mast 1 and fastened to the supporting structure 2. Guide rollers 63, 63' engaging in these guide rails 61, 61' are freely rotatably arranged on the mast carrier 10.

In this case, the guide rails 61 have a bent course in the direction of the longitudinal axis of the vehicle and in the perpendicular direction so that, during the change of the position of the mast 1 into the operating position and into the transport position, the mast swivel bearing 3 and the mast 1 are displaced in the direction of the longitudinal axis of the vehicle as well as in the perpendicular direction.

The method of operation of the described mast system will be explained in the following.

In its transport position illustrated in FIG. 1*a*, the mast 1 takes up a horizontal position with respect to its longitudinal axis on its supporting structure 2. In this case, the telescopic elements 11 have moved into the element carrier 12.

The center of gravity S of the mast system is situated at a maximally narrow distance with respect to the ground surface B on the longitudinal axis of the mast system above the wheel axle 40 of the vehicle 4.

The adjusting movement takes place by means of bearing rockers 22 about the joints 23 and 24, in which case the bearing shafts 20 on the mast carrier 10 move on a circular path about the joints 23 and 24 on the supporting structure 2 guided by the bearing rockers 22.

As described above, during this movement, a simultaneous lifting of the mast 1 takes place by means of its bearing as well as a displacement of the mast 1 in the horizontal direction, specifically in such a manner that, in the starting position for the raising of the mast 1 into the perpendicular position, the center of gravity S also comes to be situated on the longitudinal axis of the mast 1 perpendicularly above the wheel axle 40 of the vehicle 4.

When the movement of the mast takes place into the horizontal direction, the mast 1 is supported in its parallel displacement in the direction of the longitudinal axis of the vehicle by way of the bearing forks 32 by means of the guide rollers 31 and the guide rails 30 with their inclined guiding surfaces 30'.

As a result of the swivel movement of the bearing rockers 22, the bearing shafts 20 with their flattenings 26 are brought into an engagement with respect to the slots 27 in the bores 21 of the mast carrier 10 so that the bearing shafts 20 engage in the bearing bores 21 of the bearing support 18 fixed to the supporting structure 2.

The mast 1 swivels after the engagement of the bearing shafts 20 into the boring bores 21 or the slots 27 on the mast carrier 10. When the mast 1 is swivelled about the bearing shafts 20, the bearing shafts 20 lock automatically because of the rotating movement so that the mast 1 is now fixed in all directions in the bearing bores 21.

By means of the motor operator 50 and the adjusting spindle 51, which can be adjusted by way of a step-down gear (G) and a nut part, the mast 1, by way of the articulated drive 52, is swivelled about its bearing shafts 20 in the bearing bores 21 in the supporting part 18 and on the mast carrier 10 into its perpendicular operating position. In this basic position of the mast 1, the telescopic elements 11 are brought into their extended position by way of the motor operator 14 and the gearing 15.

The telescoping mast described in the embodiment is used for accommodating elements for the transmission of information or the like. However, the illustrated principle can also be used for other purposes, for example, in the case of longitudinally changeable arms for the accommodating of loads, equipment and the like.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A mobile operating system comprising:

a mobile transport carrier, a telescopic mast, and mast support structure for supporting the mast on the transport carrier while accommodating movement of the mast between a substantially horizontal untelescoped transport position and a substantially vertical telescoped stationary carrier operating position, said mast support structure including a bearing connection between the mast and the mast support structure which controls movement of the mast between the transport and operating positions such that the mast is first moved longitudinally of the carrier and is then pivotally moved to its operating position, whereby the mast center of gravity can be optimally located at the carrier for both the transport and operating positions, wherein the bearing connection includes guide rails and rollers engageable in said guide rails, said guide rails having a bent course in a direction of a longitudinal axis of said mobile transport carrier and in a perpendicular direction to control longitudinal movement of the rollers and guide rails with respect to one another.

2. A mobile operating system according to claim 1, further comprising a motor for moving the mast between its transport and operating positions.

3. A mobile operating system according to claim 1, wherein said transport carrier is a wheeled vehicle.

4. A mobile operating system according to claim 3, wherein said transport carrier includes mast support stands which lift the vehicle wheels off the ground when in a position supporting the mast in its operating position.

5. A mobile operating system according to claim 1, wherein the guide rollers are freely rotatably arranged on fork parts of a bearing fork of the supporting structure and the guide rails are fixedly connected with the mast.

6. A mobile operating system according to claim 1, wherein the center of gravity of the mast can be adjusted with respect to the mobile carrier transversely to a vehicle axis.

7. A mobile operating system comprising:

a mobile transport carrier, a telescopic mast, and mast support structure for supporting the mast on the transport carrier while accommodating movement of the mast between a substantially horizontal untelescoped transport position and a substantially vertical telescoped stationary carrier operating position, said mast support structure including a bearing connection between the mast and the mast support structure which controls movement of the mast between the transport and operating positions such that the mast is first moved longitudinally of the carrier and is then pivotally moved to its operating position, whereby the mast center of gravity can be optimally located at the carrier for both the transport and operating positions, wherein the bearing connection includes a bearing bore and a bearing pin, said bearing bore including an entry guide slot which is slidably and guidably engageable with flat surfaces of the bearing pin to control longitudinal movement of the bearing bore and bearing pin with respect to one another until said pin engages a part cylindrical wall of said bearing pin after which only pivotal movement of the bearing pin in the bearing bore is permitted.

8. A mobile operating system according to claim 7, wherein bearing rocker levers are pivotally mounted at the transport carrier and at the mast.

9. A mobile operating system according to claim 8, further comprising a motor for moving the mast between its transport and operating positions.

10. A mobile operating system according to claim 9, comprising a gearing and articulated drive connecting the motor and the transport carrier and the mast.

11. A mobile operating system according to claim 10, wherein the bearing rockers, in the perpendicular operating position of the mast, take up a perpendicular or approximately perpendicular swivelled-out position on the supporting structure of the carrier.

12. A mobile operating system according to claim 7, further comprising a motor for moving the mast between its transport and operating positions.

13. A mobile operating system according to claim 12, wherein said transport carrier is a wheeled vehicle, and wherein said transport carrier includes mast support stands which lift the vehicle wheels off the ground when in a position supporting the mast in its operating position.

14. A mobile operating system according to claim 7, wherein said transport carrier is a wheeled vehicle, and wherein said transport carrier includes mast support stands which lift the vehicle wheels off the ground when in a position supporting the mast in its operating position.

15. A mobile operating system according to claim 14, wherein said bearing bore is defined by support structure fixed to the mast, and wherein said bearing pin is connected to one end of a pivotal rocker lever which has its other end pivotally connected to the transport carrier.

16. An arrangement for accommodating a telescoping mast on a mobile carrier, comprising:

a mast swivel bearing, fixedly attached to the telescoping mast; and bearing rockers, pivotally attached to the mast swivel bearing and the mobile carrier for controlling displacement of the mast with respect to the carrier such that the mast is displaced horizontally in a particular direction in order to displace the center of gravity of the mast in the particular direction before raising the mast to a vertical operating position, wherein at a distance in the direction of the carrier longitudinal axis from the mast swivel bearing between the mast and supporting structure therefor, a mast guide is formed which comprises guide rollers and guide rails with guide ways extending in an inclined manner with respect to the horizontal line, wherein the guide rollers are freely rotatably arranged on fork parts of a bearing fork of the supporting structure and the guide rails are fixedly connected with the mast.

* * * * *